United States Patent [19]

Akashi

[11] 4,422,221

[45] Dec. 27, 1983

[54] SEPARABLE SLIDING CLASP FASTENER

[75] Inventor: Shunji Akashi, Kurobe, Japan

[73] Assignee: Yoshida Kogyo K. K., Tokyo, Japan

[21] Appl. No.: 331,876

[22] Filed: Dec. 17, 1981

[30] Foreign Application Priority Data

Dec. 24, 1980 [JP] Japan ..... 55-182103

[51] Int. Cl.[3] ..... A44B 19/00

[52] U.S. Cl. ..... 24/434; 24/381

[58] Field of Search ..... 24/205.11 R, 208 A, 24/205.16 R, 205 R

[56] References Cited

U.S. PATENT DOCUMENTS 2,098,338 11/1937 Gilmore ..... 24/205.16 R
3,900,926 8/1975 Takahashi et al. ..... 24/205.11 R
4,232,430 11/1980 Friedberg ..... 24/208 A

FOREIGN PATENT DOCUMENTS 51-135709 6/1976 Japan .
52-24161 7/1977 Japan .

*Primary Examiner*—Gene Mancene

*Assistant Examiner*—Kris R. Schulze

*Attorney, Agent, or Firm*—Hill, Van Santen, Steadman & Simpson

[57] ABSTRACT

A separable slide fastener comprises a pair of warp-knit stringer tapes each having a pair of webs which are interconnected by connector threads extending across the tape to provide a series of spaced openings receptive of stitching threads for attaching the fastener to a fabric article. A pair of rows of coupling elements is mounted on opposite longitudinal edges of the stringer tapes and taken into and out of inter-digitating engagement by a slider movable along the rows of coupling elements. The stringer tapes have at one end thereof a separable bottom end stop. A reinforcement strip preferably made of a textile material is mounted on each of the stringer tapes adjacent to the separable bottom end stop. The reinforcement strip has a series of pre-formed apertures spaced at such intervals and of such a size which are suitable for receiving threads from a knitting machine and a linking machine as well to secure the fastener to the fabric article.

7 Claims, 3 Drawing Figures

SEPARABLE SLIDING CLASP FASTENER

BACKGROUND OF THE INVENTION

1. Field of the Invention

This invention relates to a slide fastener and more particularly one of a separable type suitable for attachment to knitted articles such as cardigan sweaters and also to a method of making such fasteners.

2. Prior Art

It is known in Japan to provide a slide fastener carrying rows of interlocking elements with a series of longitudinally spaced apertures in and along the edges of its stringer tapes for receiving therein stitches or knit threads that secure the fastener to a knitted article. The provision of such apertures is intended to allow for stresses applied to the knitted article which would otherwise result in puckered or unsightly condition of the fastener at areas attached to the article. However, no effective means have been known in the art which will eliminate the aforesaid puckering tendency of a separable type of fastener, particularly at one of its ends where a separable bottom end stop is located and where stresses are pronounced as in the case of a knitted cardigan sweater.

SUMMARY OF THE INVENTION

According to the invention there is provided a separable slide fastener including a pair of stringer tapes each having a series of spaced openings receptive of stitching threads for connecting the stringer tape to a fabric article, and a pair of reinforcement strips mounted on the stringer tapes adjacent to the box and the locking pin, respectively, of a separable bottom end stop, each of the strips having a series of pre-formed thread-receiving apertures spaced longitudinally of the strip at such intervals or pitches and of such a size which will permit attachment of the fastener to an article on a knitting machine or on a linking machine.

It is an object of the present invention to provide a slide fastener of a separable construction suitable for use on knitted or otherwise flexible articles, which fastener incorporates structural features such that the tendency of the fastener to become puckered or otherwise objectionably deformed when attached to a knitted garment may be eliminated.

Another object of the invention is to provide a method of making a slide fastener having a separable end stop which has a series of apertures spaced at predetermined intervals or pitches and sized to permit the fastener to be attached to a knitted garment on a knitting machine and a linking machine as well.

Many other advantages and features of the present invention will become manifest to those versed in the art upon making reference to the detailed description and the accompanying drawings in which a preferred structural embodiment incorporating the principles of the present invention is shown by way of illustrative example.

DETAILED DESCRIPTION

Figure 1:
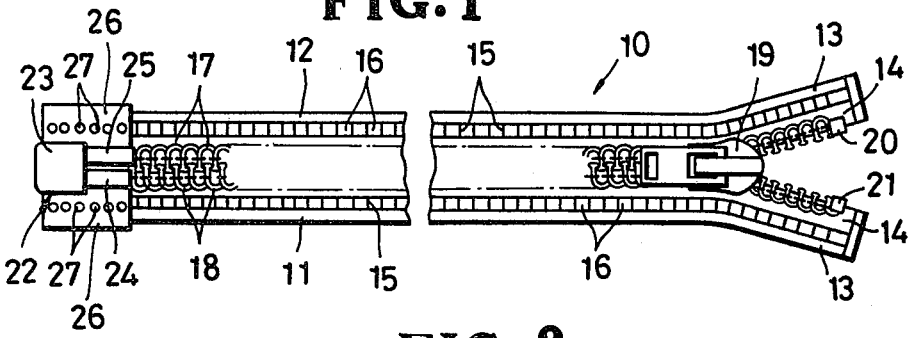
FIG. 1 is a plan view of a separable type of slide fastener provided in accordance with the invention.
Figure 2:
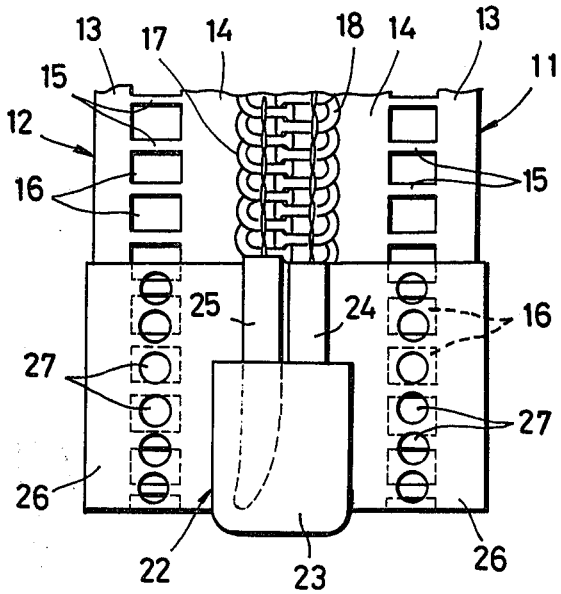
FIG. 2 is a plan view on enlarged scale of a lower or bottom portion of the fastener shown in FIG. 1.
Figure 3:
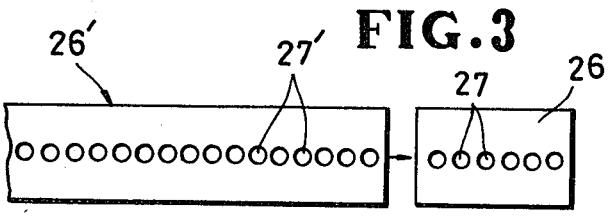
FIG. 3 is a plan view of a perforated elongated reinforcement strip to be applied to a separable end stop on the fastener.

As shown in FIGS. 1 and 2, a separable slide fastener 10 for use on a knitted article such as a cardigan sweater having completely separable opposite edges along which the fastener is to be attached, comprises a pair of warp-knit stringer tapes 11,12 each including a pair of laterally spaced elongate warp-knit webs 13,14 with a longitudinal coarse region extending therebetween. The webs 13,14 are interconnected by connector threads 15 extending transversely across the coarse region in each of the tape 11,12 at longitudinal intervals and providing a series of substantially rectangular apertures or openings 16 spaced longitudinally of the tape for receiving threads from a knitting or linking machine to secure the fastener to the knitted article. A pair of rows of coupling elements 17,18 made preferably of filamentary plastic material is mounted on the inner longitudinal edges of the opposed tapes 12,11, respectively. A slider 19 is slidably mounted on the rows of coupling elements 17,18 for taking the latter into and out of interdigitating engagement to open and close the slide fastener 10 in a well known manner.

A pair of top end stops 20,21 is secured respectively to the opposed edges of the webs 14,14 and located at the upper ends of the tapes 12,11 to prevent the slider 19 from moving beyond the rows of coupling elements 17,18. A separable bottom end stop 22 is mounted on the lower end of each of the stringer tapes 11,12 and includes a box 23 and a box pin 24 extending therefrom, the box 23 and the box pin 24 being usually injection-molded on the lower end of one stringer tape 11, and a locking pin 25 mounted on the lower end of the other stringer tape 12 and releasably engageable with the box 23.

There is provided a reinforcement strip 26 at the region of the tape 11,(12) where the separable bottom end stop 22 is located for the purpose of rendering this region of the tape rigid enough to facilitate connecting and disconnecting the separable end stop 22 by hand. A synthetic resin such as nylon might be considered for use as a material for the reinforcement strip 26, but is not satisfactory in that it is susceptible to rupture when punched or perforated. A textile fabric is more suitable for the purpose of the invention. However, when punching the fabric reinforcement strip 26, which has been previously applied to the tape, to provide a series of apertures 27 receptive of stitching threads from a knitting or linking machine, it is quite likely that the connector threads 15 would be cut and hence this portion of the tape is weakened. The interspacing between the apertures 27 may be relatively large for securing the fastener 10 on a knitting machine, but must of necessity by very small in the case of a linking machine.

It has therefore been difficult to provide the series of apertures 27 at suitable intervals and of a suitable size in the reinforcement strip 26 which has been previously applied to the fastener 10.

It has now been found that the above difficulties can be overcome by providing a continuous length of reinforcement strip 26' with pre-formed apertures 27', cutting off a pair of strips 26 of predetermined length, and applying the same to the fastener 10 closely adjacent to the box 23 and the pin 25 respectively of the bottom end stop 22. In such instance, it is desirable to register the inter-spacing or pitch of the apertures 27' with that of the openings 16 in the tape 11,(12). It is also possible to provide such apertures 27' which are suitable for attachment of the fastener 10 to a knitted article on a linking machine, because such reinforcement strip 26, upon being secured to the tape allows the needles of a knitting machine to deflect the connector threads 15 away and pass their stitching threads through the apertures 27.

It is therefore made possible according to the invention to provide a reinforcement strip 26 of any length with apertures 27 of any desired size and selected pitch such that the fastener 10 may be attached to a knitted article optionally either on a knitting machine or a linking machine.

For the foregoing description of a certain preferred embodiment, the artisan will appreciate that the invention is generally applicable to a separable slide fastener comprising a pair of woven stringer tapes each having a series of openings spaced longitudinally of the tape.

Although various minor modifications may be suggested by those versed in the art, it should be understood that I with to embody within the scope of the patent warranted hereon, all such embodiments as reasonably and properly come within the scope of my contribution to the art.

I claim as my invention:

1. A separable slide fastener comprising:

(a) a pair of stringer tapes each having a series of openings spaced longitudinally thereof at first intervals;

(b) a pair of rows of coupling elements mounted on and along a pair of opposite longitudinal edges of said stringer tapes, respectively;

(c) a slider movable along said pair of rows of coupling elements for engaging and disengaging the latter;

(d) a separable bottom end stop comprising a box and a box pin extending therefrom, which are mounted on one of said stringer tapes at one end thereof, and a locking pin mounted on the other stringer tape at one end thereof and receivable in said box; and (e) a reinforcement strip of textile material mounted on each of said stringer tapes at said one end and adjacent to said separable bottom end stop, said strip having a plurality of apertures spaced longitudinally thereof at second intervals and arranged substantially in alignment with said openings in each of said stringer tapes.

2. A separable slide fastener according to claim 1, said stringer tapes each including a pair of warp-knit webs with a wale-free coarse region extending longitudinally therebetween, and a connecting thread interconnecting said warp-knit webs transversely across said wale-free coarse region at longitudinal intervals, thereby providing a series of substantially rectangular openings arranged longitudinally in said wale-free coarse region.

3. A separable slide fastener according to claim 1, said first intervals and second intervals being substantially equal to one another.

4. A separable slide fastener according to claim 3, said apertures in said strip being located in registry with said openings in each of said stringer tapes, respectively.

5. A method for manufacturing a separable slide fastener, comprising the steps of:

(a) a providing a sliding clasp fastener stringer tape having a series of openings spaced longitudinally of said tape at first intervals, and a separable bottom end stop member mounted on one end of said tape;

(b) providing a continuous length of reinforcement strip made of textile material and having a series of apertures spaced longitudinally of said strip;

(c) cutting off a predetermined length of reinforcement textile strip from said strip of continuous length; and (d) applying said reinforcement strip of predetermined length to said stringer tape at said one end thereof adjacent to said separable end stop member such that apertures in said strip of predetermined length are arranged in alignment with said openings in said stringer tape.

6. A method according to claim 5, wherein said first intervals and said second intervals are substantially equal to one another.

7. A method according to claim 5, wherein said applying step (d) is effected such that the apertures in said reinforcement strip of predetermined length is placed in registry with openings in said stringer tape end, respectively.

* * * * *